US011549768B1

(12) United States Patent
Pischke

(10) Patent No.: US 11,549,768 B1
(45) Date of Patent: Jan. 10, 2023

(54) CHARGING HANDLE ACCESSORY WITH SIGHTING DEVICE

(71) Applicant: Sellmark Corporation, Mansflied, TX (US)

(72) Inventor: Andrew Pischke, Mansfield, TX (US)

(73) Assignee: Sellmark Corporation, Mansfield, TX (US)

( * ) Notice: Subject to any disclaimer, the term of this patent is extended or adjusted under 35 U.S.C. 154(b) by 0 days.

(21) Appl. No.: 17/539,322

(22) Filed: Dec. 1, 2021

(51) Int. Cl.

| | |
|---|---|
| ***F41A 3/72*** | (2006.01) |
| ***F41G 1/06*** | (2006.01) |
| ***F41G 1/30*** | (2006.01) |
| ***F41C 3/00*** | (2006.01) |

(52) U.S. Cl.
CPC ..... *F41A 3/72* (2013.01); *F41C 3/00* (2013.01); *F41G 1/06* (2013.01); *F41G 1/30* (2013.01)

(58) Field of Classification Search
CPC ..... F41G 1/30; F41G 1/06; F41C 3/00; F41A 3/72
See application file for complete search history.

(56) References Cited

U.S. PATENT DOCUMENTS

| | | | | |
|---|---|---|---|---|
| 8,312,803 | B2 | 11/2012 | Oz | |
| 8,468,734 | B2 * | 6/2013 | Meller | F41C 3/00 89/1.4 |
| D702,800 | S * | 4/2014 | Speroni | D22/108 |
| 9,267,759 | B2 * | 2/2016 | Speroni | F41G 1/35 |
| 9,328,991 | B2 * | 5/2016 | Gale | F41G 11/003 |
| 9,733,043 | B1 * | 8/2017 | Cohen | F41A 3/72 |
| 10,563,955 | B2 * | 2/2020 | Pniel | F41G 1/387 |
| 10,782,081 | B2 * | 9/2020 | Porat | F41A 3/72 |
| 2012/0198744 | A1 * | 8/2012 | Meller | F41C 27/00 42/90 |
| 2013/0180152 | A1 * | 7/2013 | Speroni | F41G 1/35 42/99 |
| 2014/0298703 | A1 * | 10/2014 | Gale | F41A 3/72 42/71.02 |
| 2015/0354909 | A1 | 12/2015 | Tarantino et al. | |
| 2018/0195819 | A1 * | 7/2018 | Porat | F41A 3/72 |
| 2021/0293510 | A1 * | 9/2021 | Rosen | F41G 11/00 |

OTHER PUBLICATIONS

UCH17 Glock Upper Charging Handle, Recover Tactical, https://www.recovertactical.com/product/uch-glock-upper-charging-handle/, accessed Aug. 26, 2021.

* cited by examiner

*Primary Examiner* — Joshua E Freeman
(74) *Attorney, Agent, or Firm* — Mark D. Perdue

(57) ABSTRACT

A charging handle accessory has an upper portion with a pair of parallel, spaced-apart sidewalls connected at their upper extent. The upper portion is configured to be assembled over an upper portion of the charging slide. A lower portion has a pair of parallel, spaced-apart sidewalls connected at one end. Each of the sidewalls of the lower portion has a lip configured to engage a lower extent of the charging slide. A sliding connection is provided at the lower extent of the upper portion and the upper extent of the lower portion, wherein the upper and lower portions are coupled together in sliding relation. A fastener extends between the upper and lower portions to secure the upper and lower portions against sliding relative to one another and secure them on the charging slide of the firearm.

12 Claims, 3 Drawing Sheets

CHARGING HANDLE ACCESSORY WITH SIGHTING DEVICE

BACKGROUND OF THE INVENTION

1. Field of the Invention—The present invention relates generally to accessories for improving the utility of firearms. More specifically, the present invention relates to such devices employed to improve the ergonomics of charging or cocking a semi-automatic pistol and to otherwise increase their utility.

2. Summary of the Prior Art—Virtually all semi-automatic handguns are charged or "cocked"—that is, prepared to fire (or to eject a live cartridge)—by pulling rearwardly on a slide, toggle, or other mechanical charging handle or device that is acted upon by the springs that bias the hammer and/or recoil mechanism. Accordingly, most such handguns are provided with a textured gripping surface, usually in the form of vertical linear serrations, at the rear of the slide or other charging device to increase a user's grip or purchase on the device. Even still, some users find the slide or charging device difficult to grasp and maintain a grip sufficient to counteract the spring forces as required to charge the weapon. This is particularly true for shooters who may suffer from arthritis or other hand ailments or weaknesses.

A number of devices have been proposed to aid users with grasping the charging device and charging the handgun. One such device is found in U.S. Pat. No. 10,782,081, Sep. 20, 2020 to Porat. This patent discloses a device that attaches to the rear of the charging slide of a handgun and provides an enlarged, textured gripping surface. The device is attached to the slide by engagement between the serrations on the slide and corresponding mating serrations on the interior of the disclosed device. A somewhat similar device is disclosed in U.S. Pat. No. 8,468,734, Jun. 25, 2013 to Meller et al. Some devices include rings or t-handles or other mechanisms to make the rear of the charging slide or device more easily and firmly grasped, but this type of device may make the handgun awkwardly balanced or difficult to handle in other respects.

While the devices of Pond and Meller are secured to the handgun apparently sufficiently well to carry out their purpose as charging or cocking aids, they are insufficiently secure for other purposes, specifically mounting a sighting device on the charging accessory.

A need exists, therefore, for accessories for semi-automatic handguns that assist in charging and provide a stable, secure platform for mounting a sighting device or incorporating it into the accessory.

SUMMARY OF THE INVENTION

It is a general object of the invention to provide an improved accessory for semi-automatic handguns that assists in charging or cocking the handgun and also provides a stable, secure platform for mounting a sighting device or incorporating it into the accessory.

This and other objects of the present invention are achieved by providing a charging handle accessory that has an upper portion with a pair of parallel, spaced-apart sidewalls connected at their upper extent. The upper portion may be configured to be assembled over an upper portion of the charging slide. A lower portion has a pair of parallel, spaced-apart sidewalls connected at one end. Each of the sidewalls of the lower portion has a lip configured to engage a lower extent of the charging slide. A sliding connection is provided at the lower extent of the upper portion and the upper extent of the lower portion, wherein the upper and lower portions are coupled together in sliding relation. A fastener extends between the upper and lower portions to secure the upper and lower portions against sliding relative to one another and secure them on the charging slide of the firearm.

According to one embodiment of the invention, the sliding connection further comprises a groove formed on an interior of each of the sidewalls of the lower portion and a projection formed on an exterior of each of the sidewalls of the upper portion, wherein, upon assembly together of the upper and lower portions, the projections register with the grooves.

According to another embodiment of the invention, a plurality of serrations are formed on an interior of each of the sidewalls of the upper portion, the serrations configured to engage corresponding serrations on the exterior of the charging slide.

According to still another embodiment of the invention, a sighting device carried is by the upper portion.

According to yet another embodiment of the invention, the sighting device is a reflex sight.

According to a further embodiment of the invention, a grip portion is carried on an exterior of at least one of the upper and lower portions, the grip portion configured to be grasped by a user of the accessory.

According to a still further embodiment of the invention, the grip portion further comprises a plurality of vertically extending serrations extending across the upper and lower portions.

Other objects, features, and advantages of the invention will become apparent with reference to the drawings and the detailed description, which follow.

DETAILED DESCRIPTION OF THE INVENTION

Figure 1:
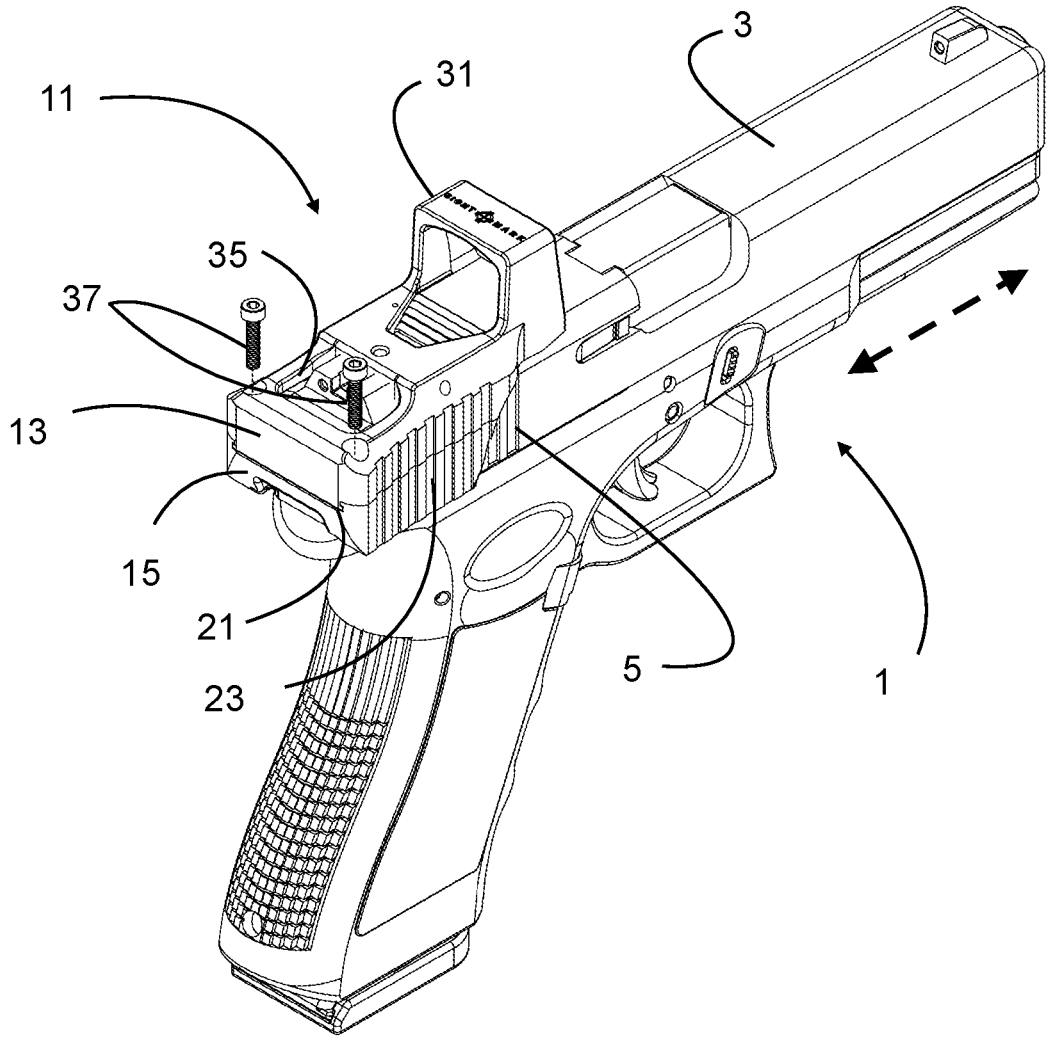
FIG. 1 is a perspective view of the charging handle accessory according to one embodiment of the invention as mounted on an exemplary handgun.

Referring now to the drawings and in particular FIG. 1, a typical semi-automatic handgun 1 is illustrated. Handgun includes a slide 3 or charging device or handle, which slides or reciprocates longitudinally (see dashed arrow) on top of the frame or remainder of handgun 1 to cycle the weapon, extracting and replacing cartridges and cocking the hammer in preparation for the next shot. To place handgun 1 in condition for semi-automatic operation, slide 3 must be manually retracted and released. It is thus provided with a textured area 5 toward its rear, to enhance the user's ability to grip slide 3. The most common texture is a plurality of parallel grooves or serrations extending vertically or nearly so across the height of slide 1, as is illustrated.

A charging handle accessory assembly 11 according to an illustrative or preferred embodiment of the present invention is depicted mounted on the rear of slide 3 of handgun 1 and partially obscures or covers a portion of serrations or grooves 5. Charging handle accessory 11 comprises an upper portion 13 and a lower portion 15 that are secured together by a sliding connection 21 and by fasteners or screws 37, as described in greater detail in connection with FIGS. 2 and 3.

At the rear of charging handle accessory 11, a grip portion 23 may be provided to enhance a user's ability to grip accessory 11, and slide 3. In the illustrative embodiment, grip portion 23 widens as it progresses to the rear of slide 3 and may also be provided with vertically extending parallel grooves or serrations (or another form of knurling or texture). Other shapes or types of grip portions or gripping surfaces may be appropriate, such as "t" handles, rings, or the like.

A sighting device 31 may be integral with charging handle accessory 11, specifically upper portion 13. In the illustrative embodiment, the sighting device may be a reflex or "red dot" sight and all of its electrical, electronic, and optical components may be carried in and by upper portion 13 of charging handle accessory 11. Other types of sighting devices (devices that permit or assist in pointing or aiming handgun 1), including lasers, flashlights, telescopic and "iron" sights, and others may be incorporated into upper portion 13. An opening or aperture 35 may be provided at the rear of upper portion 13 so that the existing rear sight of handgun 1 may protrude through the opening.

Figure 2:
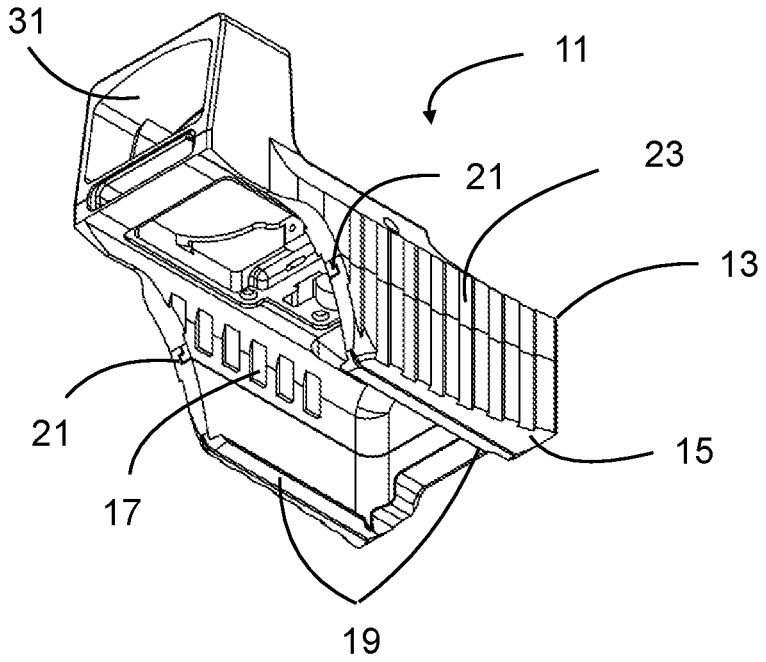
FIG. 2 is a bottom perspective view of the charging handle accessory of FIG. 1.
Figure 3:
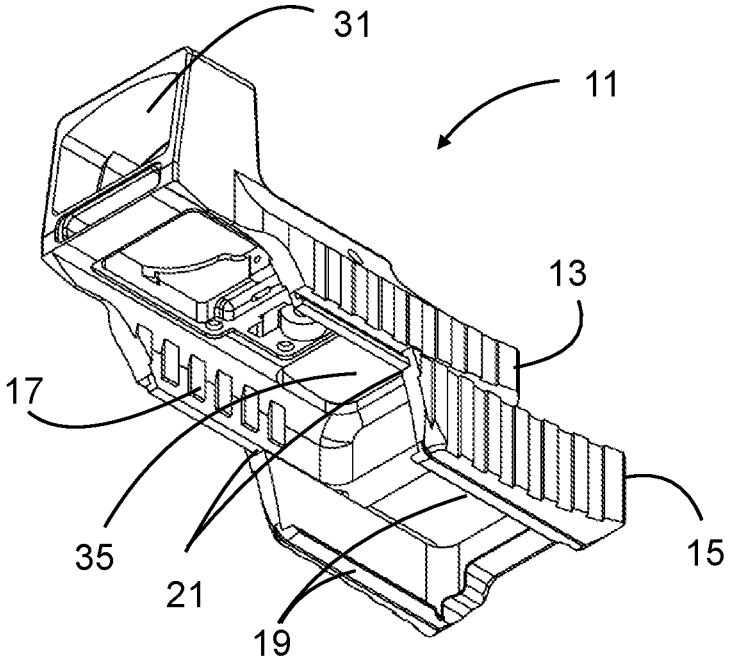
FIG. 3 is a bottom perspective view of the charging handle accessory of FIGS. 1 and 2 in a partially disassembled state.

Turning now to FIGS. 2 and 3, upper and lower portions 13, 15 of charging handle accessory 11 are depicted and described in greater detail. FIG. 2 illustrates upper 13 and lower 15 portions fully assembled together, while FIG. 3 illustrates them partially assembled together with sliding connection 21 partially engaged and lower portion 15 moved rearwardly relative to upper portion 13.

Upper portion 13 comprises a pair of generally parallel, spaced-apart sidewalls that may be connected at their upper extent and rear to form a structure that may be assembled and fit closely over the upper extent of slide 3. On the interior of each sidewall (one sidewall interior is obscured in FIGS. 2 and 3, but it is similar to that illustrated), a plurality of serrations 17 or lands and grooves may be formed in a location corresponding to those serrations 5 on the rear exterior of slide 3. Serrations 17 match or mate with those 5 on slide 3, so that when upper portion is assembled over slide, serrations 5, 17 mate, register with, and engage one another to prevent upper portion 13 from moving longitudinally relative to and along slide 3. At a lower extent or edge of each sidewall, a portion of a sliding connection 21 may be provided, as described in greater detail in connection with FIG. 4.

Lower portion 15 of charging handle accessory 11 comprises a pair of generally parallel, spaced-apart sidewalls that may be connected together at their rear. At a lower extent or edge of each sidewall, an inwardly turned lip or projection 19 may be provided that engages the lower edge or extent of slide 3 to retain assembled accessory 11 on slide 3. At an upper extent or edge of each sidewall, a portion of sliding connection 21 may be provided that mates with a corresponding portion on upper portion 13 to secure upper and lower portions 13, 15 together in sliding relation, as illustrated below in connection with FIG. 4.

Figure 4:
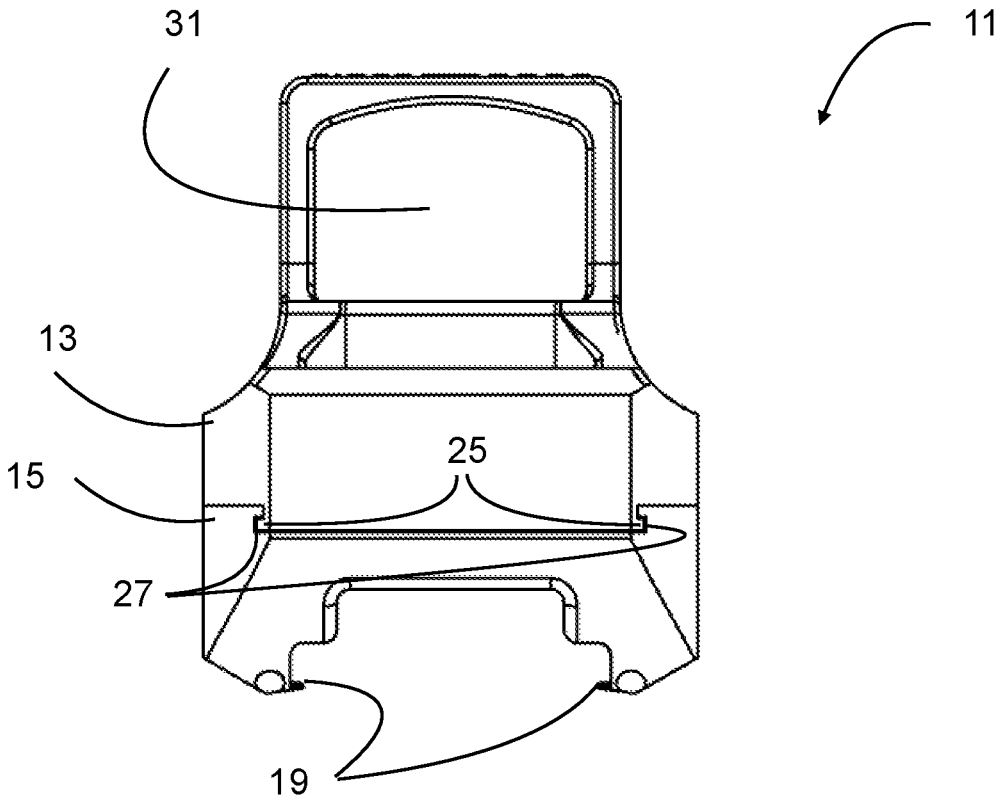
FIG. 4 is a rear end elevation view of the charging handle accessory of FIGS. 1 through 3.

FIG. 4 is a rear end view of charging handle accessory assembly 11 depicting upper and lower portions 13 secured or coupled together by a sliding connection (21 in prior figures). Sliding connection comprises a pair of opposed, outwardly facing projections 25 formed in the lower extent or edge of upper portion 13. These projections mate with corresponding inwardly facing recesses 27 formed in the upper extent of lower portion 15. When thus engaged, upper 13 and lower 15 portions are secured together and may not be separated easily, but are also slidably movable relative to one another along the sliding connection. Fasteners, preferably screws (37 in FIG. 1), may then be inserted and tightened to secure upper 13 and lower 15 portions of charging handle accessory 11 together and against movement relative to one another. Thus, slide 3 is partially enclosed by upper and lower portions 13, 15 of accessory 11 and accessory 11 is secured onto the rear portion of slide 3.

In operation, upper portion 13 of charging handle accessory 11 may be fit over the rear upper extent of slide 3 of handgun 1. Care must be taken to engage internal serrations 17 on the interior of sidewalls of upper portion with the corresponding serrations 5 on slide 3. The front of lower portion 15 then may be engaged with the rear of upper portion 13 at the rear of slide 3 so that recesses and projections 25, 27 of the sliding connection may be mated and engaged. Lower portion 15 may then be slid forward relative to upper portion 13 and slide 3, while lips or inward projections 19 engage the lower edge or extent of slide 3. When fully assembled together over slide 3, screws 37 may be inserted and tightened and thus upper and lower portions 13, 15 enclose and engage slide 3, via lips 19 and serrations 17, so that charging handle accessory 11 is securely attached to slide 3 for charging purposes and sighting device 31 will "hold zero" or retain its position relative to slide 3 and handgun 1 so that sight settings and adjustments made to it remain effective. The length of the sliding connection, extending across the mating surfaces of upper and lower portions 13, 15 contributes to the rigidity of the assembled structure and assists it in holding zero for sighting device 35. The foregoing process may be reversed to remove accessory 11 from handgun 1.

The invention has been described in connection with preferred and illustrative embodiments thereof. It is thus not limited, but is susceptible to variation and modification without departing from the scope and spirit of the invention.

I claim:

1. A charging handle accessory for a firearm of the type including a charging slide, the accessory comprising:

an upper portion having a pair of parallel, spaced-apart sidewalls connected at their upper extent, the upper portion configured to be assembled over an upper portion of the charging slide;

a lower portion having a pair of parallel, spaced-apart sidewalls connected at one end, each of the sidewalls of the lower portion having a lip configured to engage a lower extent of the charging slide;

a sliding connection at the lower extent of the upper portion and the upper extent of the lower portion, wherein the upper and lower portions are coupled together in sliding relation; and a fastener extending between the upper and lower portions to secure the upper and lower portions against sliding relative to one another and secure them on the charging slide of the firearm.

2. The charging accessory of claim 1, wherein the sliding connection further comprises:

a groove formed on an interior of each of the sidewalls of the lower portion; and a projection formed on an exterior of each of the sidewalls of the upper portion, wherein, upon assembly together of the upper and lower portions, the projections register with the grooves.

3. The charging accessory of claim 1, further comprising:

a plurality of serrations formed on an interior of each of the sidewalls of the upper portion, the serrations configured to engage corresponding serrations on the exterior of the charging slide.

4. The charging accessory of claim 1, further comprising: a sighting device carried by the upper portion.

5. The charging accessory of claim 4, wherein the sighting device is a reflex sight.

6. The charging accessory of claim 1, further comprising a grip portion carried on an exterior of at least one of the upper and lower portions, the grip portion configured to be grasped by a user of the accessory.

7. The charging accessory of claim 6, wherein the grip portion further comprises a plurality of vertically extending serrations extending across the upper and lower portions.

8. A charging handle accessory for a firearm of the type including a charging slide, the accessory comprising:

an upper portion having a pair of parallel, spaced-apart sidewalls connected at their upper extent, the upper portion configured to be assembled over an upper portion of the charging slide;

a plurality of serrations formed on an interior of each of the sidewalls of the upper portion, the serrations configured to engage corresponding serrations on the exterior of the charging slide;

a lower portion having a pair of parallel, spaced-apart sidewalls connected at one end, each of the sidewalls of the lower portion having a lip configured to engage a lower extent of the charging slide;

a sliding connection at the lower extent of the upper portion and the upper extent of the lower portion, wherein the upper and lower portions are coupled together in sliding relation;

a sighting device carried by the upper portion; and at least one threaded fastener extending between the upper and lower portions to secure the upper and lower portions against sliding relative to one another and secure them on the charging slide of the firearm.

9. The charging accessory of claim 8, wherein the sliding connection further comprises:

a groove formed on an interior of each of the sidewalls of the lower portion; and a projection formed on an exterior of each of the sidewalls of the upper portion, wherein, upon assembly together of the upper and lower portions, the projections register with the grooves.

10. The charging accessory of claim 8, wherein the sighting device is a reflex sight.

11. The charging accessory of claim 8, further comprising a grip portion carried on an exterior of at least one of the upper and lower portions, the grip portion configured to be grasped by a user of the accessory.

12. The charging accessory of claim 11, wherein the grip portion further comprises a plurality of vertically extending serrations extending across the upper and lower portions.

* * * * *